US009447556B2

(12) United States Patent
Daniel et al.

(10) Patent No.: US 9,447,556 B2
(45) Date of Patent: Sep. 20, 2016

(54) BULLET ANCHOR SYSTEM

(71) Applicant: LANDMARK EARTH SOLUTIONS, INC., Carthage, MO (US)

(72) Inventors: Barton Wade Daniel, Kennesaw, GA (US); Thomas J. Carpenter, Ankeny, IA (US); Bill Murphy, Prole, IA (US); Wade Denison, Carthage, MO (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 13/656,013

(22) Filed: Oct. 19, 2012

(65) Prior Publication Data

US 2014/0112723 A1 Apr. 24, 2014

(51) Int. Cl.
*E02D 5/80* (2006.01)
*E21D 20/00* (2006.01)

(52) U.S. Cl.
CPC ..... *E02D 5/80* (2013.01); *E21D 20/00* (2013.01)

(58) Field of Classification Search
CPC ..... E02D 5/74; E02D 5/80; E02D 5/803; E02D 17/20; E02B 3/12; E02B 3/122
USPC ..... 405/258.1, 302.4, 302.6, 302.7; 52/155, 52/156, 166; 24/16 PB; 411/338, 339, 340, 411/344
See application file for complete search history.

(56) References Cited

U.S. PATENT DOCUMENTS 4,043,245 A * 8/1977 Kaplan ..... 411/346
4,286,497 A * 9/1981 Shamah ..... 411/342
4,574,539 A * 3/1986 Deike ..... 52/163
4,657,461 A * 4/1987 Smith ..... 411/340
4,865,501 A * 9/1989 Ferris ..... 411/340
4,993,870 A * 2/1991 Bridgewater ..... 405/21
6,237,289 B1 * 5/2001 Jewett et al. ..... 52/163
6,347,435 B1 * 2/2002 Davignon et al. ..... 24/16 PB
7,695,219 B2 * 4/2010 Carpenter ..... 405/302.6
7,828,499 B2 * 11/2010 Carpenter ..... 405/302.6
7,862,259 B2 * 1/2011 Carpenter ..... 405/302.7
7,950,878 B2 * 5/2011 Carpenter ..... 405/302.6
8,157,482 B2 * 4/2012 Carpenter et al. ..... 405/259.1
8,303,224 B2 * 11/2012 McDuff et al. ..... 411/341
2009/0041548 A1 * 2/2009 Stahm ..... 405/259.1
2010/0196102 A1 * 8/2010 Carpenter et al. ..... 405/259.1

FOREIGN PATENT DOCUMENTS

FR EP 1477613 A1 * 11/2004 ..... E02D 5/803

* cited by examiner

*Primary Examiner* — Benjamin Fiorello
(74) *Attorney, Agent, or Firm* — Shook, Hardy & Bacon L.L.P.

(57) ABSTRACT

An anchor system for an erosion control mat is provided. The system includes a bullet anchor comprising a bullet anchor body and a bullet anchor strap integrally molded with and extending from a first side of the bullet anchor body. In embodiments, a lock washer is coupled to the bullet anchor strap. In embodiments, serrations on at least one side of the bullet anchor strap are adapted to prevent the lock washer from traversing the bullet anchor strap in a direction away from the bullet anchor. In embodiments, the lock washer is adapted to couple with an erosion control mat. In embodiments, an anchor tab on a second side of the bullet anchor body secures the bullet anchor body in a ground surface. The anchor system is utilized to secure the erosion control mat to the ground surface and prevent undesired movement of the erosion control mat.

15 Claims, 8 Drawing Sheets

BULLET ANCHOR SYSTEM

BACKGROUND

The present invention generally relates in general to an anchor system for anchoring material to the ground and, more particularly, to a lightweight, inexpensive, and integrally molded system which allows for quick and easy installation.

It is known in the art to provide an erosion control mat as described in U.S. Pat. No. 6,951,438 to reduce erosion. The erosion control mats are mounted to an area susceptible to erosion by first securing a pivoting anchor to a cable and driving the anchor and cable through the mat into the soil. One drawback of these systems was that the system required multiple installers, one to generate sufficient upward force to eliminate slack in the cable, while a second installer crimps a bead to the cable to prevent the mat from becoming dislodged from the ground surface.

It is also known in the art to secure these erosion control mats to a ground surface utilizing a duckbill type anchor system as described in U.S. Pat. No. 7,862,259. Duckbill anchors are provided on one end with a hardened driving point, and on the other end with a slanted "duckbill". Through the duckbill anchor is provided a slot, allowing the duckbill anchor to be engaged to a driving rod. Near the center of the duckbill anchor is a connection point where a steel cable is connected to the anchor. The driving rod is used to push the duckbill anchor into the ground to a predetermined depth. The friction between the earth and the anchor retains the anchor as the driving rod is removed thereform. Applying a force to the cable causes the duckbill portion of the anchor to tilt so that the length of the anchor is nearly perpendicular to the cable. This perpendicular orientation increases the surface area and, therefore, the drag against the earth as greater pressure is applied to the cable. One drawback of this type of system is the requirement that the duckbill anchor, and more specifically, the driving portion of the duckbill anchor, be constructed of a strong, expensive material, such as hardened steel or the like.

More recently, lightweight and inexpensive anchoring systems, such as those described in U.S. Pat. No. 8,157,482, were designed. These anchor systems include an anchor having a generally cylindrical body and a frusto conical cap. Provided through the body is a slot, through which is provided a driver. The driver extends through the frusto conical cap of the body to expose the tip of the driver. Coupled to the body is a catch, to which is secured a line. The driver is then used to insert the body into the ground to a predetermined depth. Once the predetermined depth is reached, the driver is removed and force is applied to the line to wedge the anchor against removal.

Unfortunately, in each of the systems described above, a complex securement of the cable to the anchor is required. The cable (i.e. line or strap) can easily become dislodged or loosened from the catch on the anchor body. This results in excess slack in the line or undesired movement away from the intended anchor location. Even a slight movement in the anchor or the bead results in some amount of "play" between the mat and the ground. This results in undesired erosion. Further, the surface area that resists dislodgement of the anchor is limited to the cylindrical or duckbill shape of the anchor body. The difficulties encountered in the prior art discussed hereinabove are substantially eliminated by the present invention.

BRIEF SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention relate to an anchor system. In one embodiment, the anchor system comprises a bullet anchor with a bullet anchor body and a bullet anchor strap. The bullet anchor strap is integrally molded with and extends from a first side of the anchor body. A lock washer is coupled to the bullet anchor strap.

In another embodiment, a method for anchoring an erosion control mat to a ground surface is provided. The method comprises providing a bullet anchor. The bullet anchor comprises a bullet anchor body and a bullet anchor strap integrally molded with and extending from a first side of the bullet anchor body. The bullet anchor strap includes serrations on at least one side. The method further comprises coupling a lock washer to the bullet anchor strap. The serrations on the bullet anchor strap are adapted to prevent the lock washer from traversing the bullet anchor strap in a direction away from the bullet anchor body. An erosion control mat having a plurality of apertures is positioned at a desired location on a ground surface. A driving rod drives the bullet anchor through one of the plurality of apertures in the erosion control mat to a predetermined depth of a ground surface. Tension is applied to the bullet anchor strap. The lock washer is slid along the bullet anchor strap towards the erosion control mat.

In another embodiment, an anchor for anchoring an erosion control mat to a ground surface is provided. A bullet anchor comprises a bullet anchor body and a bullet anchor strap. The bullet anchor strap includes serrations on at least one side and is integrally molded with and extends from a first side of the bullet anchor body.

These and other aspects of the invention will become apparent to one of ordinary skill in the art upon a reading of the following description, drawings, and the claims.

DETAILED DESCRIPTION

Figure 1:
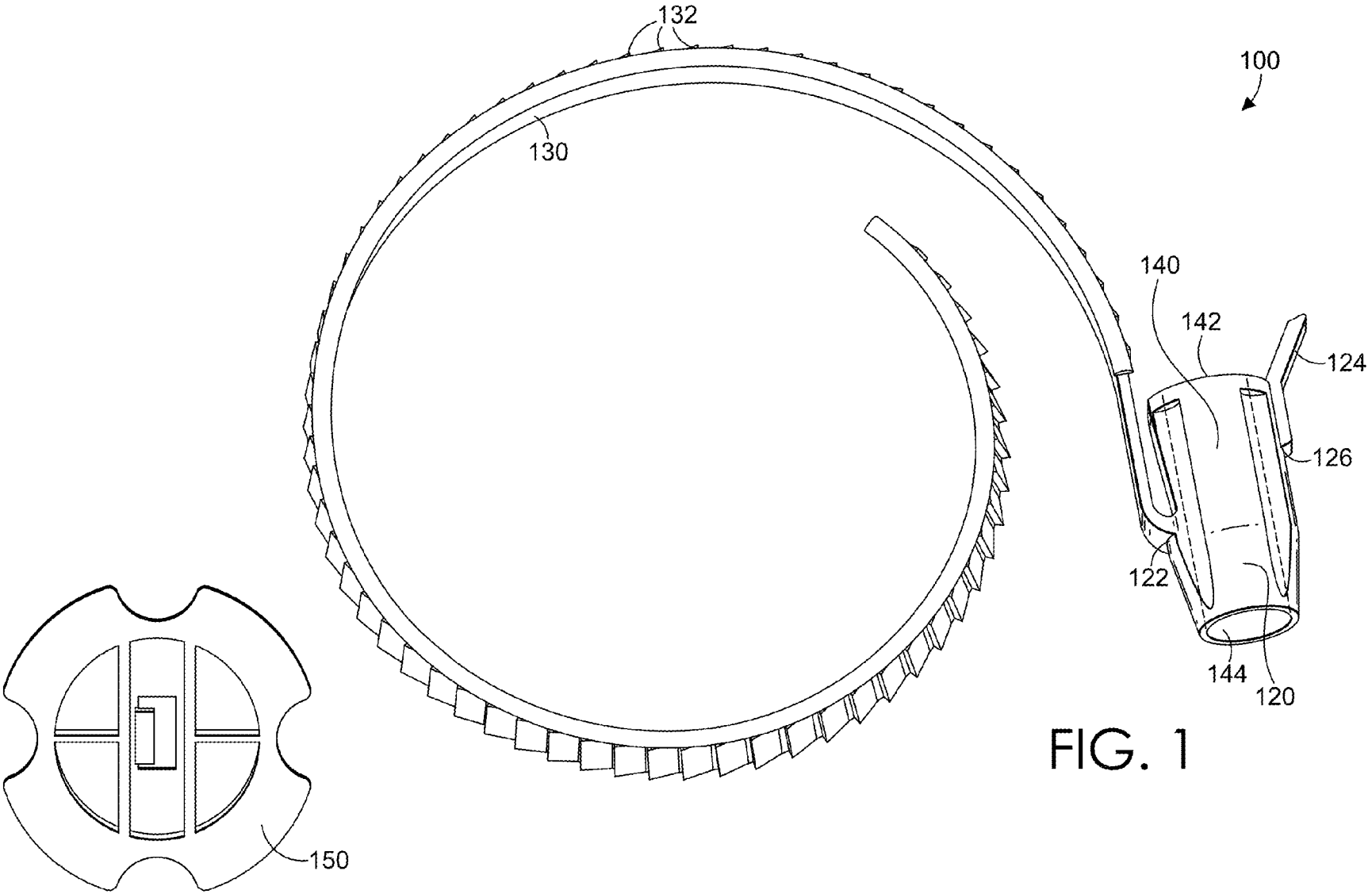
FIG. 1 illustrates a perspective view of bullet anchor in accordance with an embodiment of the present invention.

Referring to the drawings, and particularly to FIG. 1, a perspective view of a bullet anchor 100 is illustrated in accordance with an embodiment of the present invention. The bullet anchor 100 comprises a bullet anchor body 120 and a bullet anchor strap 130. The bullet anchor strap includes serrations 132 on at least one side. In one embodiment, the serrations 132 on the bullet anchor strap 130 are adapted to receive a lock washer 150. In one embodiment, the serrations 132 on the bullet anchor strap 132 are further adapted to prevent the lock washer from traversing the bullet anchor strap 130 in a direction away from the bullet anchor body 120. In other words, the serrations 132 allow the lock washer movement in only one direction. This allows the lock washer to secure an erosion control mat to a ground surface without requiring a cap or any additional items that may easily be lost or misplaced. Further, this greatly reduces the time and number of workers required to adequately secure the erosion control mat to the ground surface because the serrations 132 on the bullet anchor strap 130 and the lock washer are adapted to prevent any applied tension from being lost. This allows a single worker to slide the lock washer against the erosion control mat and hold the lock washer in place while applying additional tension to the bullet anchor strap 130.

The bullet anchor strap 130 is also integrally molded with and extending from a first side 122 of the bullet anchor body 120. Because the bullet anchor strap 130 is integrally molded with the bullet anchor body 120, there is no need for a complex securement of the bullet anchor strap 130 to the bullet anchor body 120. This also removes the risk of the bullet anchor strap 130 from being loosened or unsecured from the bullet anchor body 120. In addition, the configuration of the bullet anchor strap 130 (i.e., extending from a first side 122 of the bullet anchor body 120) causes the bullet anchor body 120 to tilt when tension is applied to the bullet anchor strap 130, thereby increasing the surface area that resists dislodgement of the bullet anchor body 120.

In one embodiment, the bullet anchor body 120 further comprises an anchor tab 124 integrally molded to a second side 126 of the bullet anchor body 120. The anchor tab 124 provides additional surface area that resists dislodgement and loosening of the bullet anchor body 120. In one embodiment, the anchor tab 124 is angled. This increases the effectiveness of the additional surface area by providing resistance against movement in more than one plane. More specifically, each plane is providing resistance against the two directions that could dislodge or loosen the bullet anchor body 120 (i.e., vertical and towards an angle associated with the erosion control mat).

In one embodiment, the bullet anchor body 120 includes a driving rod receiving portion 140. The driving rod receiving portion 140 includes an entrance 142 and an exit 144. A driving rod is inserted into the entrance 142 of the driving rod receiving portion 140. The bullet anchor body 120 is shaped such that only the tip of the driving rod is capable of passing through the exit 144 of the driving rod receiving portion 140. In one embodiment, the bullet anchor body 120 is cylindrical, narrowing from the entrance 142 towards the exit 144.

Figure 2:
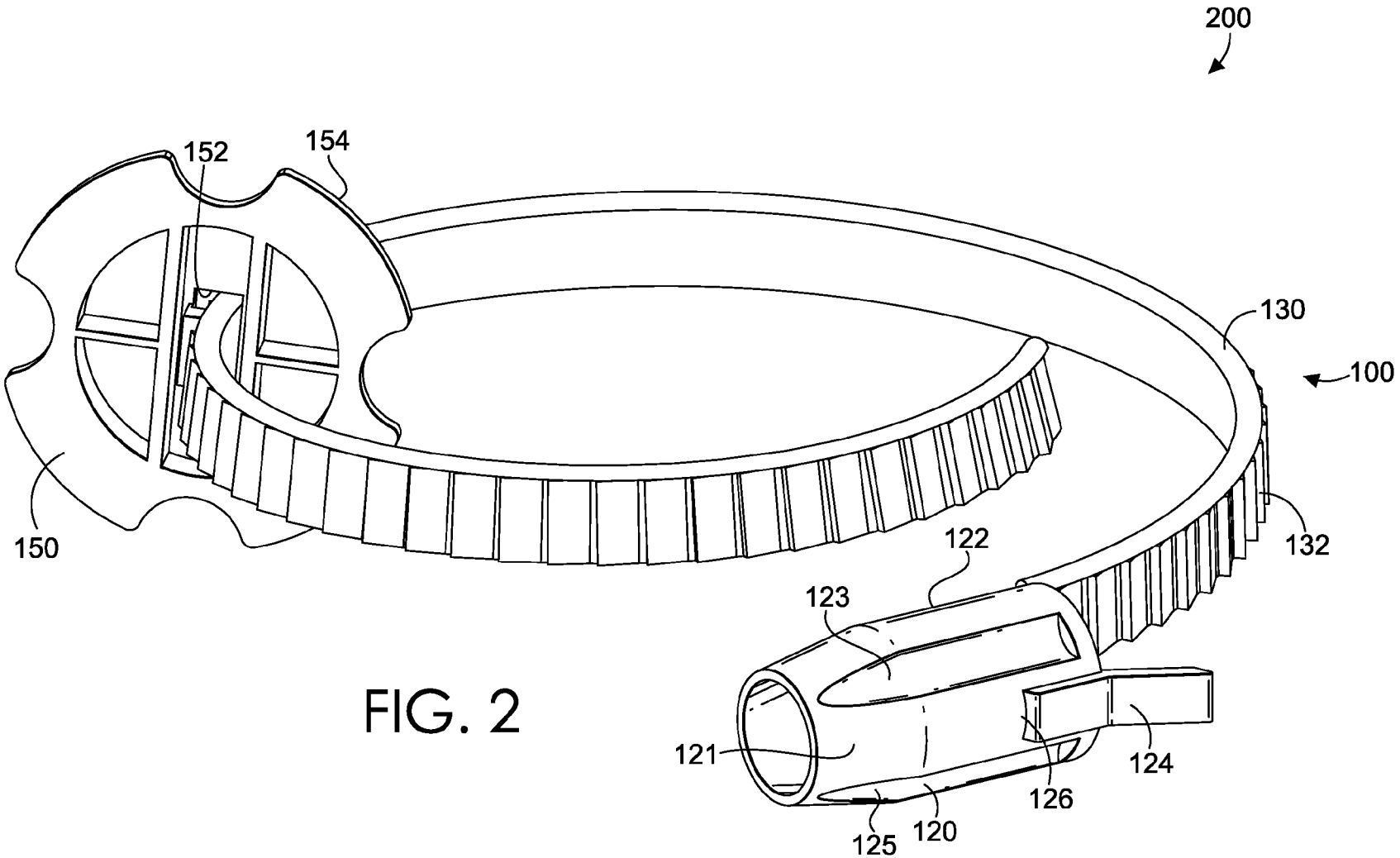
FIG. 2 illustrates a perspective view of an anchor system in accordance with an embodiment of the present invention.

Referring now to FIG. 2, a perspective view of an anchor system 200 is illustrated in accordance with an embodiment of the present invention. The anchor system 200 comprises a bullet anchor 100 and a lock washer 150. Bullet anchor 100 is configured as described above with respect to FIG. 1. For clarity, the bullet anchor 100 includes a bullet anchor body 120 and a bullet anchor strap 130. The outer surface of the bullet anchor body 120 can include at least a portion 123 and a portion 125 that are recessed relative to a portion 121. The bullet anchor strap 130 is integrally molded with and extending from a first side 122 of the bullet anchor body 120. The lock washer 150 is fed onto and coupled to the bullet anchor strap 130.

In one embodiment, the bullet anchor strap 130 includes serrations 132 on at least one side. The serrations 132 on the bullet anchor strap 130 are adapted to receive and couple with the lock washer 150. The serrations 132 on the bullet anchor strap 130 are adapted to prevent the lock washer from traversing the bullet anchor strap 130 in a direction away from the bullet anchor body 120.

The lock washer 150 includes an interior slot 152 adapted to receive an end of the bullet anchor strap 230 and traverse the bullet anchor strap 130 towards the bullet anchor body 120. At least one side 154 of the lock washer 150 is adapted to couple to one of a plurality of apertures on an erosion control mat.

The bullet anchor body 120 further comprises an anchor tab 124 integrally molded to a second side 126 of the bullet anchor body 120. The anchor tab 124 can be positioned between the two recessed portions 123 and 125 of the outer surface of the bullet anchor body 120. The anchor tab 124 provides additional surface area that resists dislodgement and loosening of the bullet anchor body 120. In one embodiment, the anchor tab 124 is angled. The angle of the anchor tab 124 increases the effectiveness of the additional surface area by providing resistance against movement in more than one plane. More specifically, each plane is providing resistance against the two directions that could dislodge or loosen the bullet anchor body 120 (i.e., vertical and towards an angle associated with the erosion control mat). The anchor tab grabs soil when upward force is applied to the installed bullet anchor strap 130 thus causing the bullet anchor body 120 to rotate in the soil to a perpendicular position.

Figure 3:
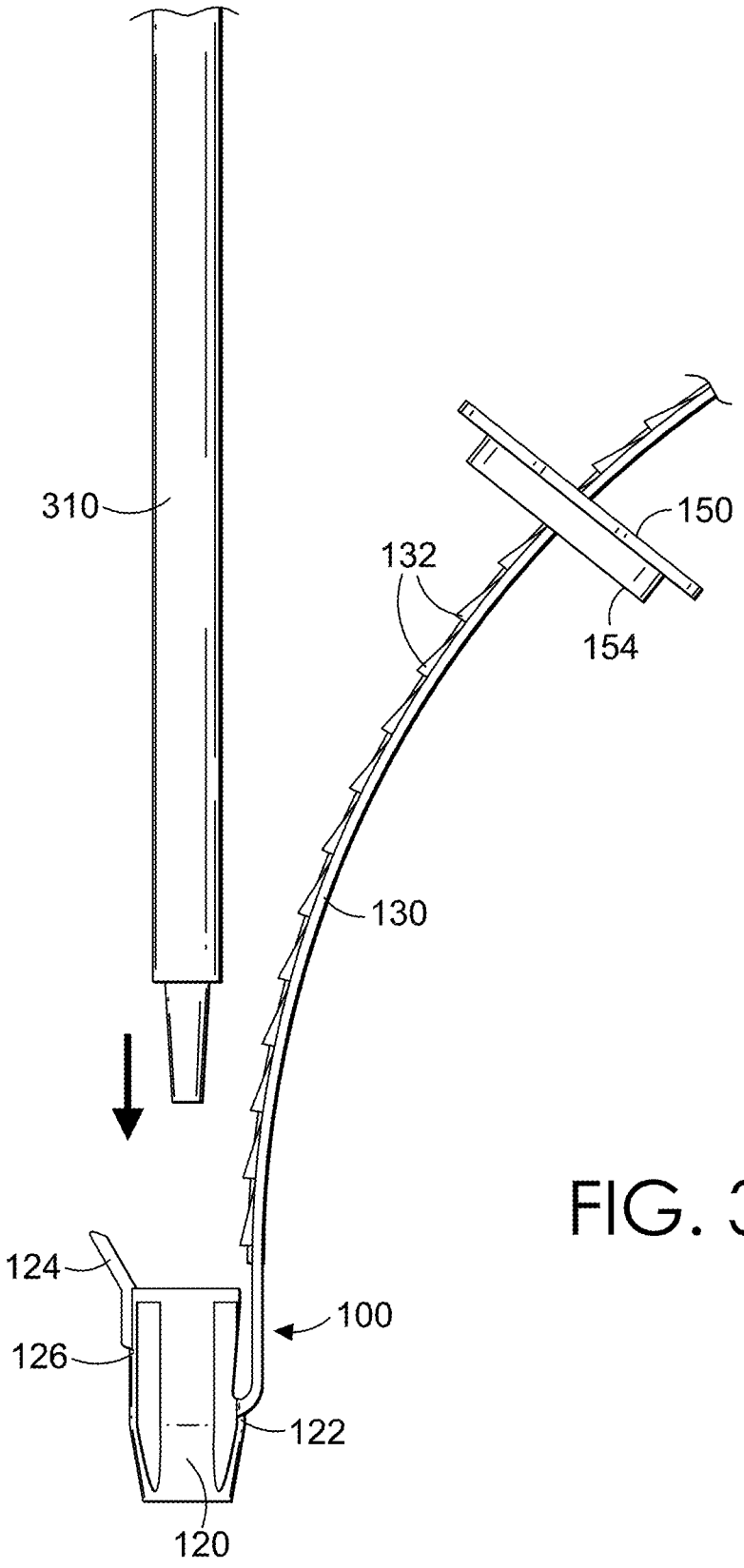
FIG. 3 illustrates a side elevation showing the driving rod being positioned into the bullet anchor for securement below ground in accordance with an embodiment of the present invention.

In practice, and referring to FIGS. 3-8, a method of anchoring an erosion control mat to a ground surface in accordance with embodiments of the present invention is illustrated. Referring to FIG. 3, a driving rod 310 and a bullet anchor 100 are provided. The bullet anchor 100 comprises a bullet anchor body 120 and a bullet anchor strap 130 integrally molded with and extending from a first side 122 of the bullet anchor body 120. In one embodiment, the bullet anchor body 120 includes an anchor tab 124 integrally molded to a second side 126 of the bullet anchor body 120 opposite the bullet anchor strap 130. The bullet anchor strap 130 includes serrations 130 on at least one side. A lock washer 150 is coupled to the bullet anchor strap 130. The serrations 132 on the bullet anchor strap 130 prevent the lock washer 150 from traversing the bullet anchor strap 130 in a direction away from the bullet anchor body 120.

Figure 4:
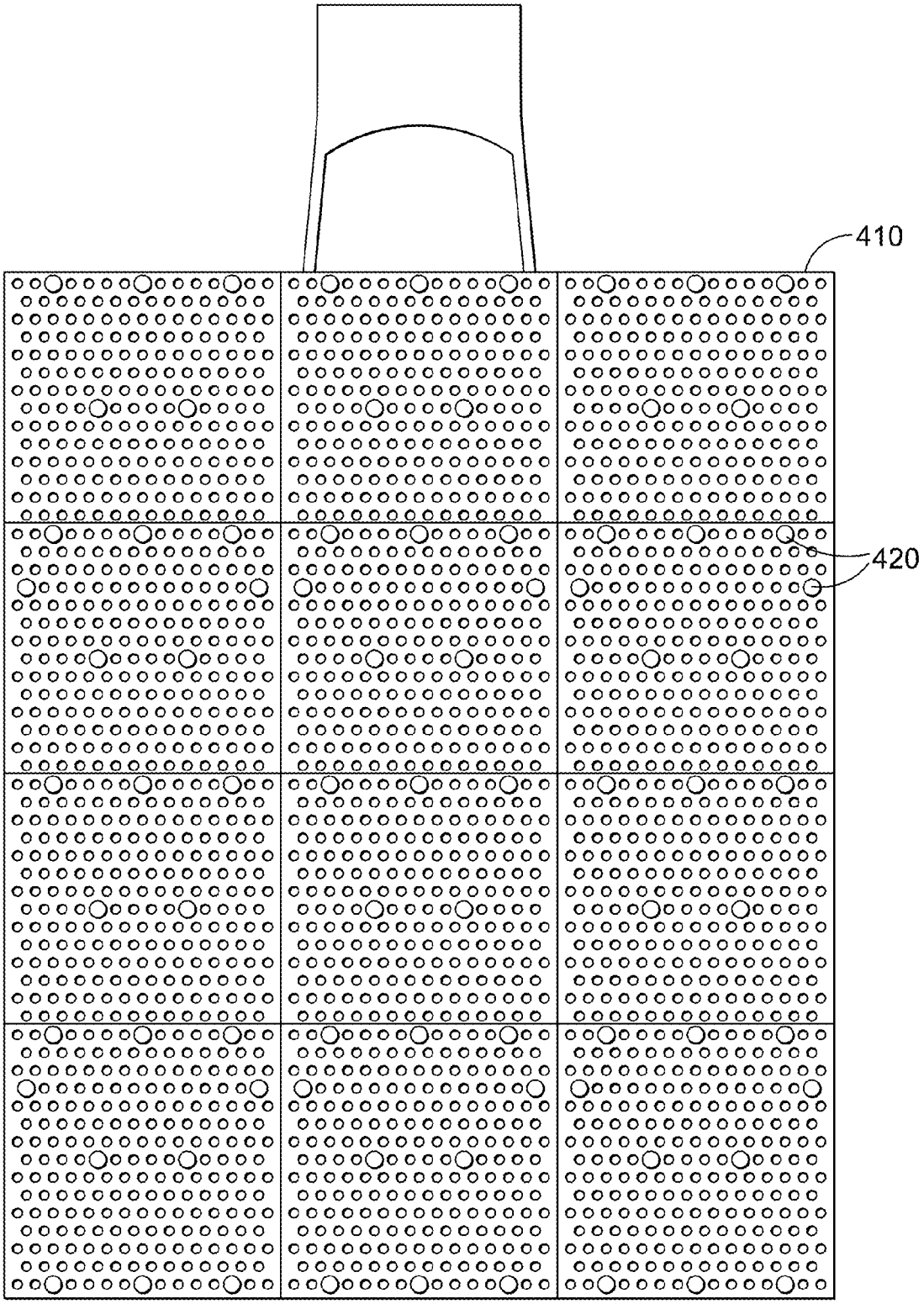
FIG. 4 illustrates a top plan view of a plurality of erosion control mats for securement by the bullet anchor of the present invention in accordance with an embodiment of the present invention.
Figure 5:
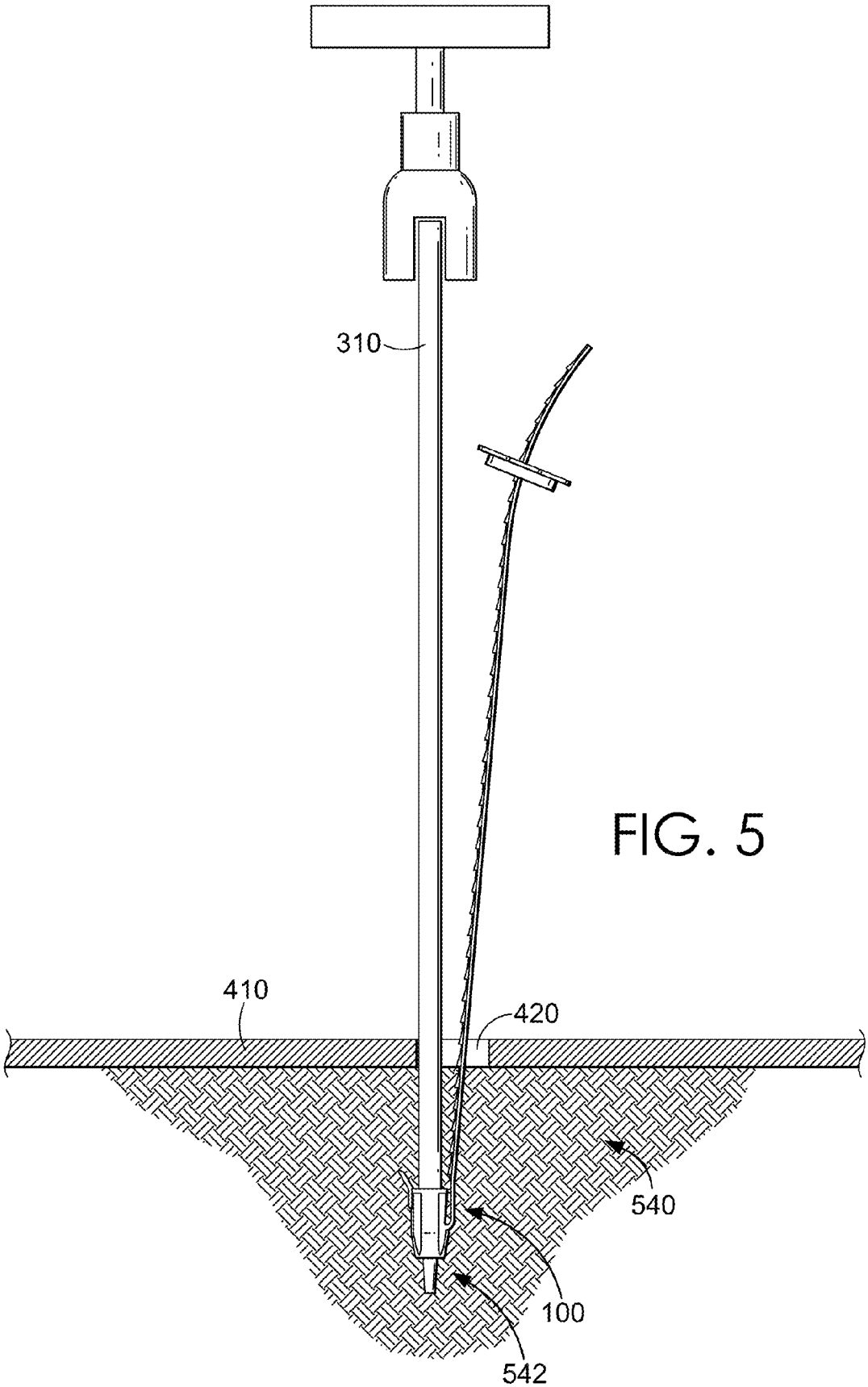
FIG. 5 illustrates a side elevation in partial cross-section of the driving rod positioning the bullet anchor below the ground in accordance with an embodiment of the present invention.
Figure 6:
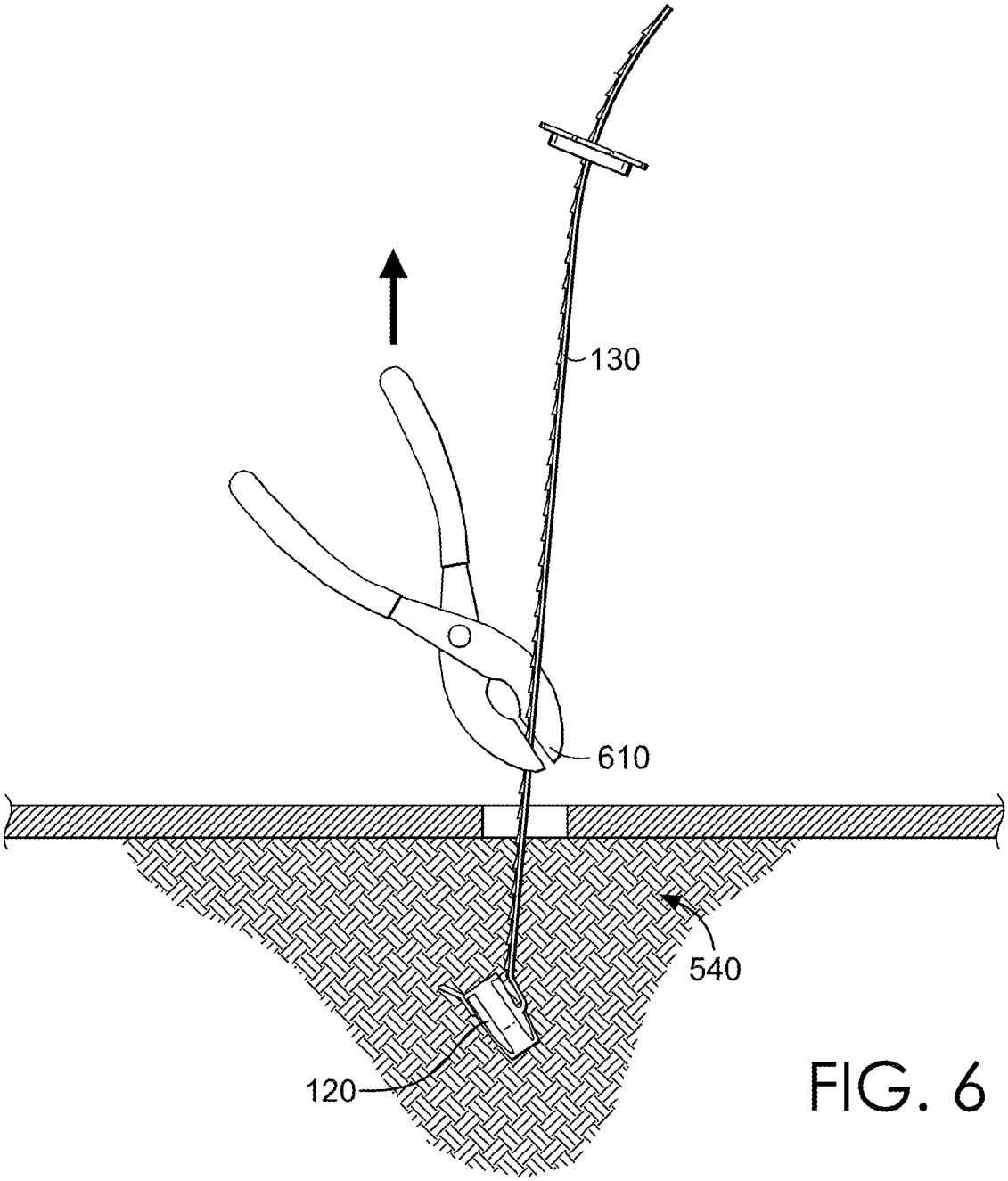
FIG. 6 illustrates a side elevation in partial cross-section of tension being applied to the bullet anchor to set the bullet anchor into position in accordance with an embodiment of the present invention.

Referring now to FIG. 4, an erosion control mat 410 having a plurality of apertures 420 is positioned at a desired location on a ground surface. Referring now to FIG. 5, a driving rod 310 drives the bullet anchor 100 through a plurality of one of the apertures 420 in the erosion control mat 410 to a predetermined depth 542 of a ground surface 540. Referring now to FIG. 6, tension 610 is applied to the bullet anchor strap 130. In one embodiment, applying tension 610 to the bullet anchor strap 130 causes the bullet anchor body 120 to tilt. In one embodiment, tilting the bullet anchor body 120 sets the anchor tab securing the bullet anchor body 120 in the ground surface 540.

Figure 7:
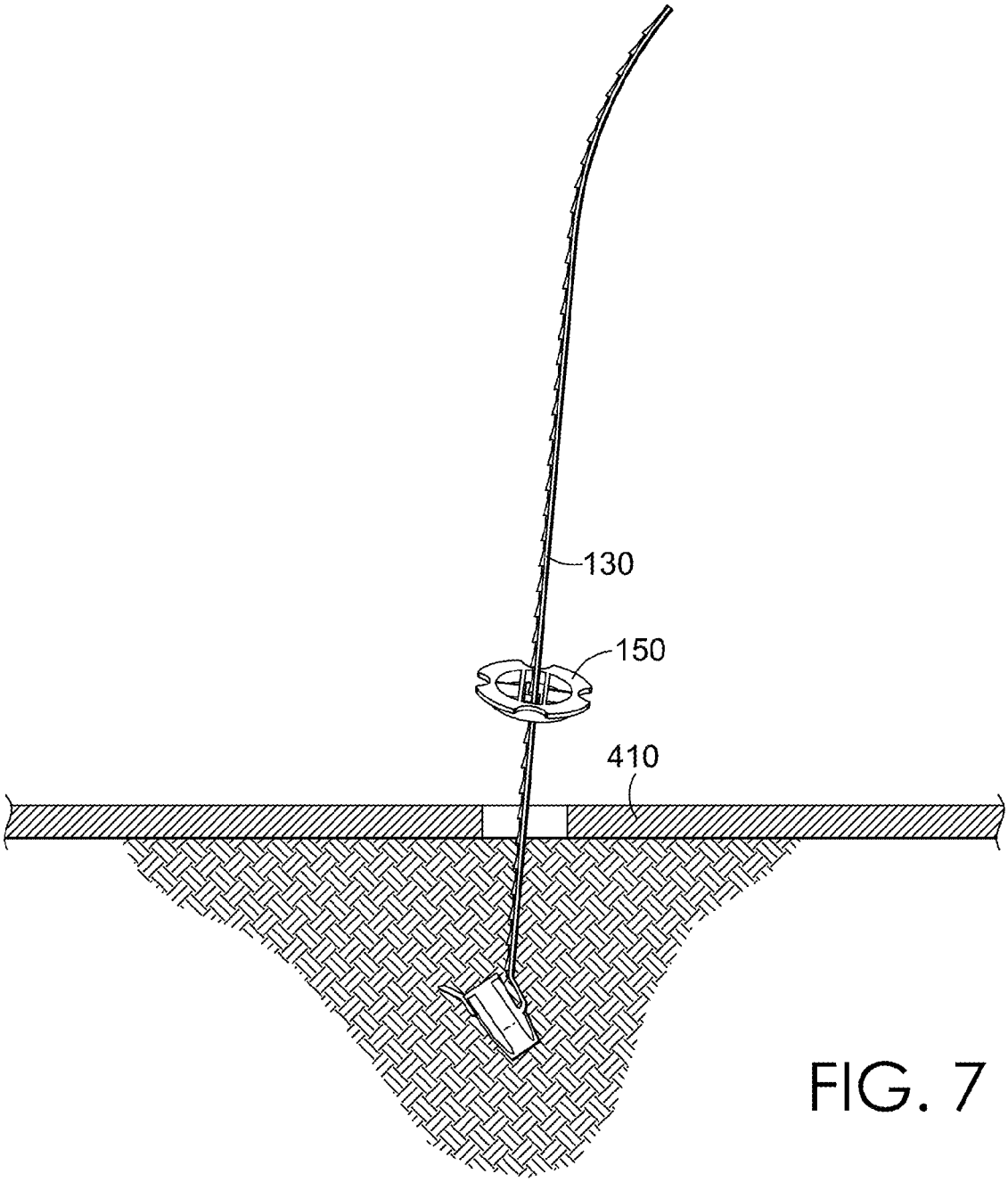
FIG. 7 illustrates a side elevation in partial cross-section of the lock washer being coupled to the bullet anchor strap in accordance with an embodiment of the present invention.
Figure 8:
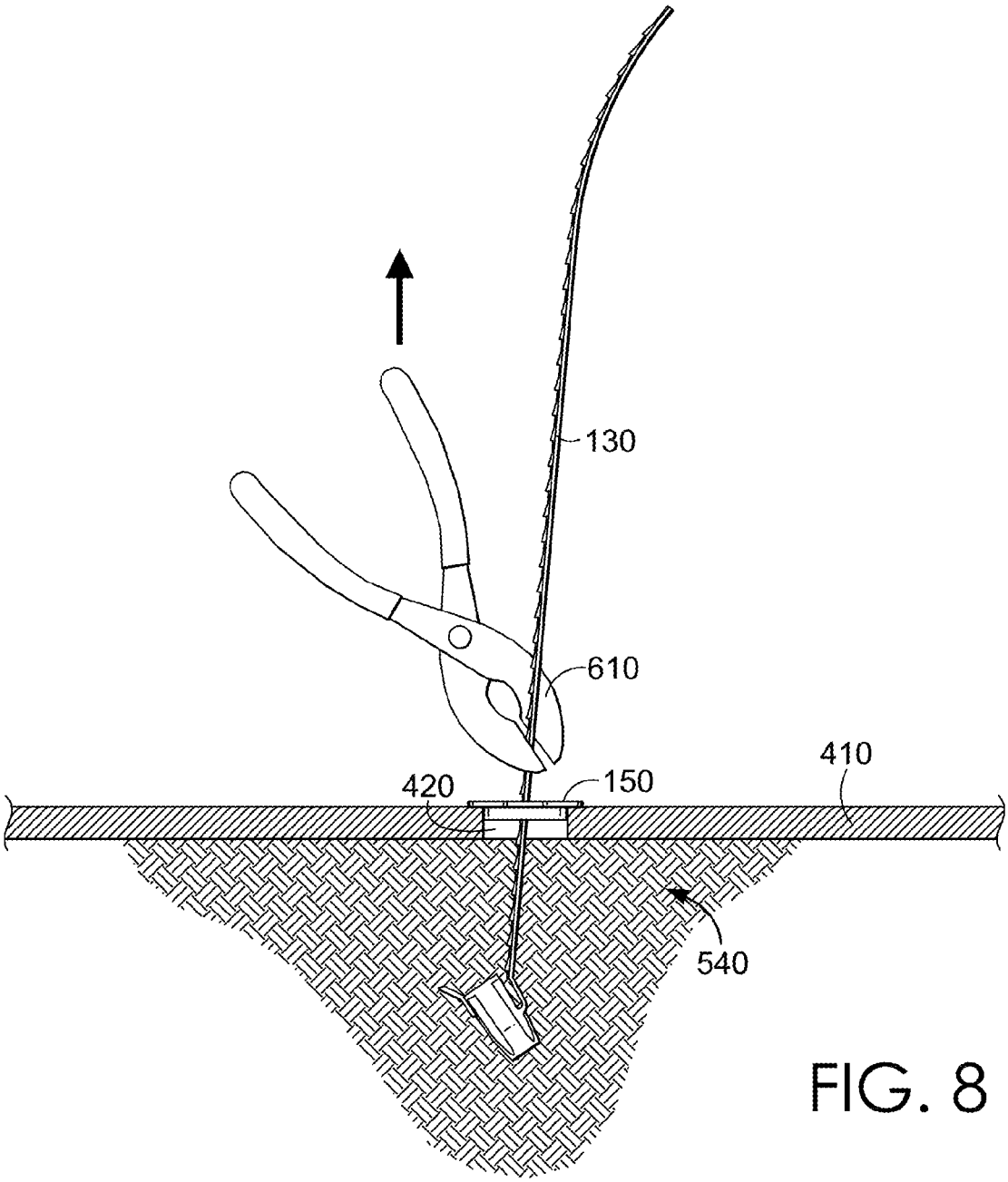
FIG. 8 illustrates a side elevation in partial cross-section of the lock washer being coupled to the erosion control mat in accordance with an embodiment of the present invention.

Referring now to FIG. 7, the lock washer 150 is slid along the bullet anchor strap 130 towards the erosion control mat 410. Referring now to FIG. 8, in one embodiment, the lock washer 150 is coupled to one of the plurality of apertures 420 in the erosion control mat 410. In one embodiment, applying tension 610 to the bullet anchor strap 130 and coupling the lock washer 150 to one of the plurality of apertures 420 in the erosion control mat 410 secures the erosion control mat 410 to the ground surface 540.

The present invention has been described in relation to particular embodiments, which are intended in all respects to be illustrative rather than restrictive. Alternative embodiments will become apparent to those of ordinary skill in the art to which the present invention pertains without departing from its scope. Although an erosion control mat is utilized as an example that is secured by the bullet anchor system, it is contemplated that many other items can be secured by the bullet anchor system including a turf reinforcement mat, geotextile, landscape fabric, plants trees, articulated concrete blankets, articulated concrete blocks, sediment control products, and the like. Each of these items are contemplated and within the scope of the present invention.

From the foregoing, it will be seen that this invention is one well adapted to attain all the ends and objects set forth above, together with other advantages which are obvious and inherent to the system and method.

It will be understood that certain features and subcombinations are of utility and may be employed without reference to other features and subcombinations. This is contemplated by and is within the scope of the claims.

The invention claimed is:

1. An anchor system, comprising:

a bullet anchor with a bullet anchor body and a bullet anchor strap, the bullet anchor body comprising at least one sidewall, the at least one sidewall having first and second opposing ends, wherein the first and second opposing ends are configured to receive at least a portion of a driving rod such that the at least a portion of the driving rod extends through a driving rod receiving portion of the bullet anchor body and past each of the first and second ends, wherein the at least one sidewall comprises an exterior surface, wherein at least a first portion of the exterior surface is recessed compared to a second portion of the exterior surface, wherein the first portion extends along the exterior surface from a first region adjacent to the first end of the at least one sidewall to a second region adjacent the second end of the at least one sidewall, wherein at least a part of the second portion of the exterior surface is positioned between the first region and the first end of the at least one sidewall, and wherein the driving rod receiving portion is distinct from the first and second portions of the exterior surface;

the bullet anchor strap integrally molded with and extending from a first side of the bullet anchor body; and a lock washer adapted to be coupled to the bullet anchor strap, wherein at least a portion of the lock washer is adapted to be inserted into at least one of a plurality of apertures on an erosion control mat.

2. The anchor system of claim 1, wherein the bullet anchor strap includes serrations on at least one side.

3. The anchor system of claim 2, wherein the serrations on the bullet anchor strap are adapted to prevent the lock washer from traversing the bullet anchor strap in a direction away from the bullet anchor body.

4. The anchor system of claim 3, wherein the plurality of apertures are adapted to receive the bullet anchor.

5. The anchor system of claim 4, further comprising the driving rod for driving the bullet anchor through one of the plurality of apertures in the erosion control mat to a predetermined depth of a ground surface.

6. The anchor system of claim 1, wherein the lock washer includes an interior slot adapted to receive the end of the bullet anchor strap opposite the bullet anchor body.

7. The anchor system of claim 6, wherein the lock washer is adapted to traverse the bullet anchor strap towards the bullet anchor body.

8. The anchor system of claim 7, wherein at least one side of the lock washer is adapted to couple to one of the plurality of apertures on the erosion control mat.

9. The anchor system of claim 1, wherein the bullet anchor body includes a notch anchor integrally molded to a second side of the bullet anchor body opposite the bullet anchor strap.

10. An anchor for anchoring an erosion control mat to a ground surface, the anchor comprising:

a bullet anchor comprising a bullet anchor body and a bullet anchor strap, the bullet anchor body comprising at least one sidewall having an exterior surface, wherein the at least one sidewall comprises first and second opposing ends, wherein at least a first portion of the exterior surface is recessed compared to a second portion of the exterior surface, wherein a third portion of the exterior surface is recessed compared to the second portion of the exterior surface, wherein the first and third portions extend along the exterior surface from a first region adjacent to the first end of the at least one sidewall to a second region adjacent the second end of the at least one sidewall, wherein at least a part of the second portion of the exterior surface is positioned between the first region and the first end of the at least one sidewall, and wherein the first and third portions are spaced apart from one another, the bullet anchor strap including serrations on at least one side and integrally molded with and extending from a first side of the bullet anchor body; and a lock washer adapted for coupling to the bullet anchor strap, wherein at least a portion of the lock washer is adapted to be inserted into at least one of a plurality of apertures on an erosion control mat.

11. The anchor of claim 10, wherein the bullet anchor further comprises a notch anchor integrally molded to a second side of the bullet anchor body opposite the bullet anchor strap, and wherein the notch anchor is positioned between the first and third portions.

12. The anchor of claim 11, wherein the bullet anchor body includes a driving rod receiving portion.

13. The anchor of claim 11, further wherein the serrations on the bullet anchor strap are adapted to receive the lock washer.

14. The anchor of claim 13, wherein the serrations on the bullet anchor strap are further adapted to prevent the lock washer from traversing the bullet anchor strap in a direction away from the bullet anchor body.

15. An anchor for anchoring an erosion control mat to a ground surface, the anchor comprising:

a bullet anchor comprising a bullet anchor body and a bullet anchor strap, the bullet anchor body comprising at least one sidewall having an exterior surface, wherein the at least one sidewall comprises first and second opposing ends, wherein at least a first portion of the exterior surface is recessed compared to a second portion of the exterior surface, wherein a third portion of the exterior surface is recessed compared to the second portion of the exterior surface, wherein the first and third portions extend along the exterior surface from a first region adjacent to the first end of the at least one sidewall to a second region adjacent the second end of the at least one sidewall, wherein at least a first part of the second portion of the exterior surface is positioned between the first region and the first end of the at least one sidewall, wherein at least a second part of the second portion of the exterior surface is positioned between the second region and the second end of the at least one sidewall, and wherein the first and third portions are spaced apart from one another, the bullet anchor strap including serrations on at least one side and integrally molded with and extending from a first side of the bullet anchor body, wherein the bullet anchor further comprises a notch anchor integrally molded to a second side of the bullet anchor body opposite the bullet anchor strap, wherein the notch anchor is positioned between the first and third portions of the bullet anchor body.

* * * * *